US011612531B2

(12) United States Patent
Schuster

(10) Patent No.: US 11,612,531 B2
(45) Date of Patent: Mar. 28, 2023

(54) REPOSITIONING SYSTEM FOR THE SAFE REPOSITIONING OF A PATIENT

(71) Applicant: Jürg O. Schuster, Zumikon (CH)

(72) Inventor: Jürg O. Schuster, Zumikon (CH)

( * ) Notice: Subject to any disclaimer, the term of this patent is extended or adjusted under 35 U.S.C. 154(b) by 0 days.

(21) Appl. No.: 17/026,086

(22) Filed: Sep. 18, 2020

(65) Prior Publication Data

US 2021/0244593 A1 Aug. 12, 2021

(51) Int. Cl.
*A61G 7/10* (2006.01)

(52) U.S. Cl.
CPC ..... *A61G 7/1038* (2013.01); *A61G 7/1051* (2013.01)

(58) Field of Classification Search
CPC ..... A61G 1/013; A61G 1/048; A61G 7/103; A61G 7/1032; A61G 7/1038; A61G 7/1051
See application file for complete search history.

(56) References Cited

U.S. PATENT DOCUMENTS

| | | | | |
|---|---|---|---|---|
| 5,263,213 | A * | 11/1993 | Robertson | A61G 1/00 5/601 |
| 5,966,754 | A * | 10/1999 | Schuster | A61G 7/1032 5/81.1 R |
| 6,374,435 | B1 | 4/2002 | Leininger | |
| 2005/0102750 | A1* | 5/2005 | Berge | A61G 7/1026 5/81.1 HS |

FOREIGN PATENT DOCUMENTS

| | | | | |
|---|---|---|---|---|
| AT | 514214 | A1 * | 11/2014 | |
| DE | 102008052968 | B3 * | 4/2010 | A61G 7/1032 |
| DE | 10 2009 048 564 | B3 | 2/2011 | |
| DE | 102009048564 | B3 * | 2/2011 | A61G 7/103 |
| DE | 10 2008 052 968 | B3 | 4/2020 | |
| EP | 1621176 | A2 * | 2/2006 | A61G 7/1032 |
| GB | 2387321 | A * | 10/2003 | A61G 7/103 |
| KR | 100838171 | B1 * | 6/2008 | |
| WO | 2017205780 | A1 | 11/2017 | |
| WO | WO-2017205780 | A1 * | 11/2017 | A61G 7/103 |

OTHER PUBLICATIONS

German Patent Office, Office Action for German Patent Application No. 10 2019 125 327.6, dated Aug. 20, 2020, 8 pages.
European Patent Office, Extended European Search Report for EP Application No. 20197030.8, dated Feb. 15, 2021, 8 pages.

* cited by examiner

*Primary Examiner* — David R Hare
*Assistant Examiner* — Alexis Felix Lopez
(74) *Attorney, Agent, or Firm* — Socal IP Law Group LLP; Angelo Gaz

(57) ABSTRACT

The invention relates to a transfer device with a roll cloth for transferring patients, wherein the roll cloth has a tubular sleeve with two open ends. In order to satisfy high standards of hygiene and to permit easy cleaning, the roll cloth has, at each of the open ends of the sleeve, a peripheral end profile with an inner face and an outer face, which end profile is elastic, wherein, in the ready-to-use state of the roll cloth, the inner face of an upper portion of the end profile lies on the inner face of a lower portion of the end profile.

15 Claims, 5 Drawing Sheets

REPOSITIONING SYSTEM FOR THE SAFE REPOSITIONING OF A PATIENT

RELATED APPLICATION INFORMATION

This patent claims priority from German Patent Application No. DE 10 2019 125 327.6, filed Sep. 20, 2019 all of which are incorporated herein by reference in their entirety.

The invention relates to a transfer device according to the preamble of claim 1. Within the meaning of this disclosure, a device can also be understood as a system which can comprise a plurality of individual objects, elements or components. In particular, the transfer device can also be designated as a transfer system.

In hospitals and care facilities or in mobile rescue units, it is often necessary to transfer a patient from one support surface to another. Examples of said support surfaces are beds, stretchers, operating tables or the like. The person to be transferred may be greatly restricted in terms of their movement or may be completely incapable of moving. It is not unusual for such a transfer of a patient to require more than two assistants. In addition, it often involves a great deal of strength. Therefore, in the cases mentioned above, special transfer devices called "roll boards" are used, which make it possible to move patients from one support surface to another without having to lift the patient.

Various transfer devices are already known from the prior art. For example, U.S. Pat. No. 4,051,565 A discloses a device for transferring patients between an operating table and a bed, said device having a mat-like conveyor, similar to a sleeping bag with open ends. The conveyor has a lower coefficient of friction on its inner face than on its outer face, as a result of which an upper portion of the conveyor can be displaced relative to a lower portion of the conveyor with only a relatively slight force being applied. On account of the high static friction of the outer face, the patient remains on the upper portion, and a translational movement or rolling movement is then effected by the relative movement between the upper portion and the lower portion. The movement is comparable to that of a conveyor belt. In this way, a patient can be transferred from one support surface to another via the transfer or transporting device. However, a solution of this kind has the disadvantage that it does not have a stable shape. It can therefore bridge only very narrow gaps between the support surfaces and can easily sink into depressions in one of the support surfaces or in the gap.

U.S. Pat. No. 4,744,115 A discloses a further transfer device for moving a patient from one supporting surface to another with the aid of a sliding/rolling movement. The transfer device described in said document comprises essentially two parts that can be folded over each other.

DE 38 06 470 A1 discloses a transporting device with a roll cloth in the form of an endless mat which is wound around a relatively rigid board, wherein the frictional resistance between the roll cloth and the board is so low that it can be overcome by one person even when a patient is located on the transporting device.

DE 195 12 008 C1 discloses a transporting device with an endless mat which surrounds a foldable board-shaped body that can be filled with air, wherein the sliding properties of the endless mat relative to the board-shaped body permit a translational movement with only slight force being applied. In addition, by adapting the air pressure of the board-shaped body, the properties of the transporting device in terms of providing a comfortable surface to lie on can be adapted to the specific requirements of a particular situation.

The object of the invention is to make available a transfer device having a roll cloth that is easy to handle and to clean.

This object is achieved by a transfer device or transfer system having the features of claim 1. Advantageous embodiments are set forth in the dependent claims.

In a transfer device or transfer system with a roll cloth which has a tubular sleeve with two open ends, wherein the roll cloth has, at each of the open ends of the sleeve, a peripheral end profile with an inner face and an outer face, which end profile is elastic, wherein, in the ready-to-use state of the roll cloth, the inner face of an upper portion of the end profile lies on the inner face of a lower portion of the end profile, provision is made according to the invention that an inner body is received inside the tubular sleeve, wherein the sleeve of the roll cloth is longer than the inner body.

The tubular sleeve here is produced from a slidable and tear-resistant material usable in the medical field and in particular has a lower coefficient of friction on its inner face than on its outer face. Materials are preferred which are ozone-resistant and halogen free. Examples of materials that can be used are plastics such as polyamides (nylon). In order to enhance the sliding properties, the sleeve can have a high degree of slidability at least on the inner face and can optionally be coated for this purpose. An inner body for stiffening purposes can then be received inside the roll cloth, wherein a low frictional resistance can be achieved by matching the surface of the inner body to the inner face of the sleeve such that the roll cloth, even with a patient lying on it, can be moved around the inner body by application of a slight force.

The sleeve or the roll cloth surrounds the inner body relatively loosely here. When transferring a patient, the latter can then be pushed together with the roll cloth by application of a relatively low force, wherein the roll cloth moves around the inner body. The patient is thus transferred from one support surface to another by one or more attendants exerting pushing or pulling movements. Movements or efforts on the part of the patient are not required. The coefficient of friction between the inner face of the sleeve and the surface of the inner body is so low that slight forces alone are sufficient to transfer heavy or overweight patients between beds. The weight to be transferred thus decreases to less than 20% of the actual body weight of the patient, namely, from experience, to 15-18% of the body weight. For example, if a patient weighs 100 kg, a weight of only 15-18 kg has to be transferred. The relatively stiff inner body also makes it possible to safely bridge a larger gap between the respective support surfaces and can also take up more local loads. The inner body is in this case produced in particular from a dimensionally stable, age-resistant and lightweight plastic, with ozone-resistant and halogen-free materials preferably being used.

By virtue of the fact that the upper portion of the end profile lies particularly flat on the lower portion substantially across the full width of the roll cover, the open ends of the sleeve are as it were closed. Contaminants such as liquid are thus reliably prevented from getting into the interior of the roll cloth. This permits simple cleaning of the roll cloth and allows high standards of hygiene to be maintained. At the same time, the rolling movement of the roll cloth is not impeded, and therefore a patient can be transferred with only slight force being applied.

Preferably, the end profile has a thickness of between 0.5 cm and 2.5 cm and a height of between 3 cm and 10 cm. With such a thickness, it is possible to obtain a sufficient elasticity and flexibility of the end profiles such that, on the one hand, the resistance to a rolling movement is kept low and, on the other hand, the portions of the end profiles lying over one another can lie securely on each other. In connection with the corresponding height, a sufficient leaktightness is achieved and the penetration of contaminants into the interior of the roll cloth can be reliably avoided, so as to meet new hygiene regulations.

The end profile advantageously has a rubber-like material. A rubber-like material can be processed quite easily and allows the end profiles to be produced with the desired elasticity or flexibility. In addition, such a material is resistant to many chemicals and does not take up moisture. High standards of hygiene can thus be achieved. A material with the above compositions has proven particularly advantageous.

In a preferred development, at least one concave recess is formed on the inner face and/or the outer face of the end profile. The stability of the end profile to deformations can be influenced via such a concavity, wherein it is also possible for a plurality of concave recesses to be combined, for example two on the inner face and one on the outer face, or similar.

It is particularly preferable if the end profile is designed as a hollow-chamber profile with at least one hollow chamber which extends parallel to the end of the sleeve. It is thus possible, on the one hand, to reduce the weight and the amount of material used and, on the other hand, to set the desired elasticity.

Preferably, the hollow-chamber profile has at least two hollow chambers which lie next to each other in the longitudinal direction. In this way, the width of the end profiles can be utilized effectively, wherein a web that separates the hollow chambers at the same time stabilizes the end profiles.

In a preferred embodiment, the end profile has a flat fastening portion which is covered by the sleeve and is in particular sewn to the sleeve, wherein the hollow chambers lie outside the sleeve. The fastening portion positioned inside the sleeve constitutes a sufficiently large contact surface for the sleeve to permit reliable fastening, for example by sewing, adhesive bonding, etc. Since the sleeve itself is produced from a very much thinner material than the end profile, there is also an almost stepless transition from the sleeve to the end profiles, and therefore reliable cleaning with minimal effort can also be ensured there.

In a possible embodiment, the hollow-chamber profile extends an equal distance on both sides of a plane in which the fastening portion lies. The hollow-chamber profile is in particular designed symmetrically with respect to this plane. In this way, when assembling the end profiles, they can be positioned in any desired way, and the risk of incorrect assembly is thus very low.

In an alternative embodiment, the hollow-chamber profile extends by different distances on both sides of a plane in which the fastening portion lies. In particular, it extends further in the direction of the inner face than in the direction of the outer face. In this way, on the one hand, the end profile can be safely positioned at its inner faces and, on the other hand, it does not protrude so far in the region of its outer faces.

In a preferred development, the inner body has a first board and a second board which are connected pivotably to each other along a pivot axis via a connection element, wherein the connection element has a first holding profile and a second holding profile. The connection element thus constitutes a kind of hinge that connects the two boards of the inner body pivotably to each other. These boards are in particular produced from a foam material.

The connection element permits a foldability of the inner body. Provision is made in particular that the first board is connected pivotably to the second board along a pivot axis. For this purpose, the connection element has a first holding profile and a second holding profile. The pivotability of the connection element can either be achieved by a joint system or hinge system or, as provided for in a preferred embodiment, by a flexible part of the connection element, which flexible part is produced from a flexible material. By virtue of this embodiment, the transfer device can be folded up and thus stowed and transported in a way that saves space. In order to fold it up, one board for example can be pivoted through ca. 180°, in such a way that it then lies on the other board. It is also conceivable for both boards to be folded together simultaneously, with each of the boards being pivoted through an angle of ca. 90°. In the state when folded out, the transfer device has a shape like a stretcher and can be used as such to safely transfer a patient. However, transfer devices or systems are also conceivable which use an individual, non-foldable board.

As material for the connection element, it is possible to use a plastic, for example elastomers, i.e. vulcanizates of natural rubber and/or silicone rubber or the like. The holding profiles have in particular a halogen-free and latex-free material.

According to a preferred design measure of the invention, the first holding profile and the second holding profile each have a receiving region, wherein an edge region of the first board is received at least in part with form-fit engagement in the receiving region of the first holding profile, and an edge region of the second board is received at least in part with form-fit engagement in the receiving region of the second holding profile. The connection element can be designed in particular in the form of a batten, wherein the batten-shaped connection element extends substantially across the full width of the unfolded inner body. It is thereby possible to avoid the appearance of gaps or spaces, for example, in the region of the connection element The result is that the patient is transferred particularly safely.

The receiving regions of the holding profiles are preferably designed as U-shaped clamps or brackets, thus allowing the boards to be received with form-fit engagement by the receiving regions. The form-fit engagement ensures an initial fixing of the holding profiles on the boards, because slipping of the holding profiles on the boards is prevented. The connection of the holding profiles to the boards, in a manner secure against movement, is achieved preferably via mechanical connections, for example rivet connections. The holding profiles can additionally be connected to the boards by adhesive bonding, screwing or clamping.

In an advantageous development, an edge region of the first board has a lesser thickness compared to the rest of the first board, wherein the edge region of the second board has a lesser thickness compared to the rest of the second board. Edge regions configured in this way make it easier to insert the boards into the receiving regions of the holding profiles. Ideally, the difference in thickness between the edge region of a board and the rest of the board corresponds approximately to the wall thickness of the receiving regions. In this way, a substantially smooth transition can be ensured between the board and the respective holding profile.

According to a preferred variant of the invention, the first board and the second board are produced from foam. This ensures that the inner body has a low weight, as a result of which the handling of the transfer device is made easier. In addition, foam is a material that is durable and able to bear loads and that can be produced in the desired stiffness and has no water absorption or at any rate very little water absorption. High standards of hygiene can accordingly be maintained and a long useful life ensured.

Advantageously, the first holding profile is fixed by a fixing device to the edge region of the first board, and the second holding profile is fixed by a further fixing device to the edge region of the second board. The fixing device ensures that the holding profiles are rigidly connected to the boards. Thus, particularly in difficult transfer procedures, a reliable connection of the boards to the holding profiles of the connection element is ensured. In addition, a secure fixing or fastening of the holding profiles to the boards ensures a high quality of the transfer device. The fixing device can comprise, for example, a kind of bolt or rivet system. However, it is also conceivable for the holding profiles to be sewn or adhesively bonded to the boards.

It is particularly advantageous that the fixing device comprises a set screw and a threaded sleeve which are inserted in opposite directions into the receiving region. Fixing devices of this kind are reliable and are also easy to fit in place. Screwing the holding profiles to the boards is less difficult than sewing them on, for example. It is thus possible to save time and thus reduce costs in the production of the transfer device.

According to a preferred embodiment, provision can be made that the first holding profile and the second holding profile each have a connection region, which is in each case designed in a direction counter to the receiving region. The connection regions can, for example, receive opposite ends of the connection element via which the first holding profile and the second holding profile can be connected to each other.

Another advantageous embodiment is one in which the connection element has a flexible element with two profile ends, which flexible element is arranged between the first holding profile and the second holding profile. It is also possible that the profile ends have connection geometries for connecting one profile end to the connection region of a respective holding profile, or are formed in one piece with these. For example, the connection regions each have a groove which extends across the width of the transfer device and into which the profile ends of the holding profiles are inserted. The flexible element advantageously permits a pivotability of the connection element. For this purpose, it is produced from an elastic and preferably virtually non-flammable material.

According to a preferred embodiment, the flexible element is strip-shaped and extends substantially along the entire edge region of the boards. In other words, the flexible element extends substantially across the full width of the transfer device. In this way, a gap-free transition between the first board and the second board is ensured, as a result of which the unfolded inner body has a more or less complete board structure in which there are no gaps or spaces even in the region of the connection element. By using the flexible element, it is also possible to dispense with hinge elements, which results in simpler production of the connection element and therefore of the foldable inner body. By way of the recesses of the profile ends of the flexible element, the flexible element can additionally be joined to the connection region via a clamped connection, effortlessly and without additional components. The connection regions for this purpose have webs, which are received by the recesses of the profile ends. In this way, it is possible to prevent the profile ends from accidentally slipping out of the connection regions.

In a preferred development, provision is made that an outer cross-sectional periphery of the inner body is slightly smaller than an inner cross-sectional periphery of the tubular roll cloth. For example, the outer cross-sectional periphery of the inner body is 0.2 to 1 cm, in particular ca. 0.5 cm smaller than the inner cross-sectional periphery of the roll cloth. This ensures that the roll cloth is relatively tight when it surrounds the inner body, but at the same time that it can also be easily moved around the inner body. In connection with a low coefficient of friction between the inner face of the roll cloth and the surface of the inner body, slight forces alone are then sufficient to transfer heavy or overweight patients between beds.

The invention is explained in more detail below on the basis of a preferred illustrative embodiment and with reference to the schematic figures, in which.

Figure 5B:
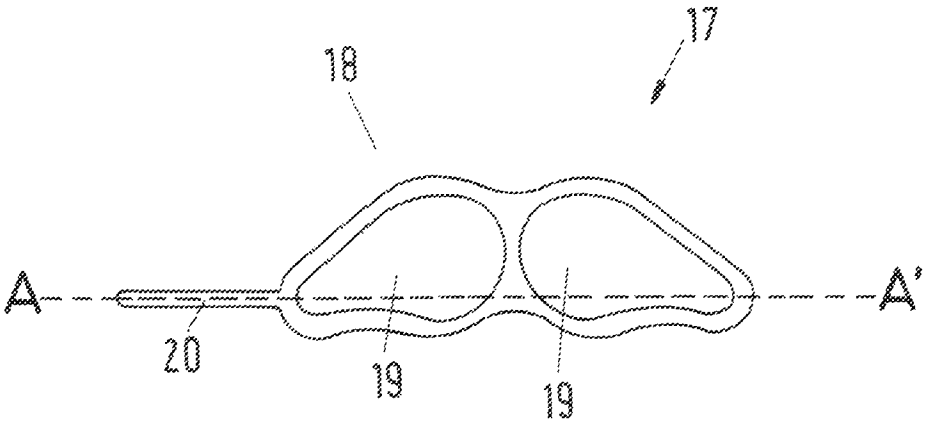
Figure 5A:
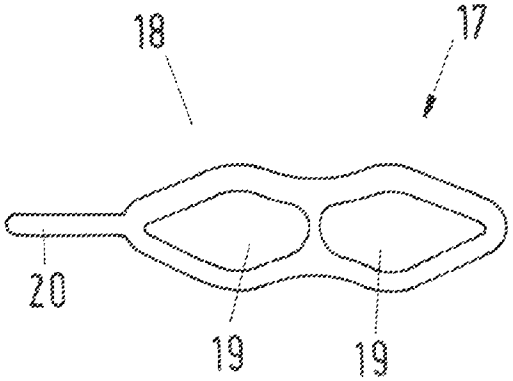

FIG. 5*a* shows a sectional side view of a hollow-chamber profile;

FIG. 5*b* shows a sectional side view of an alternative embodiment of the hollow-chamber profile.

Figure 1:
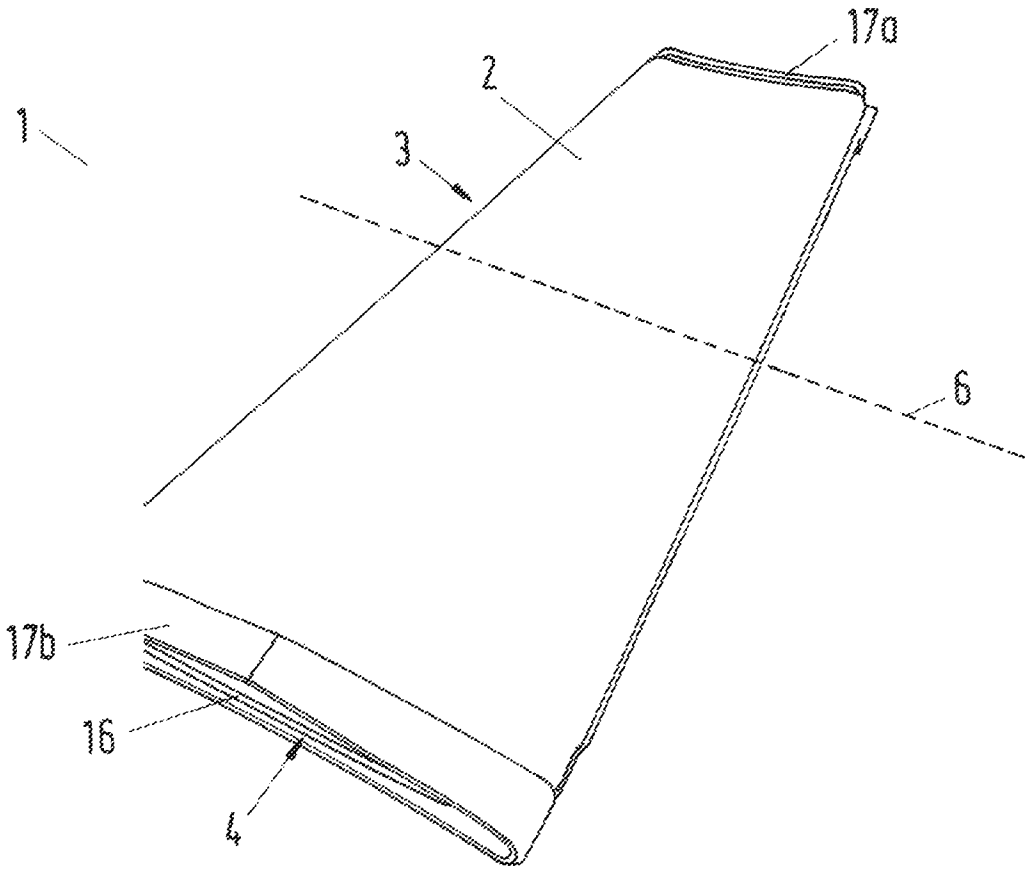
FIG. 1 shows a transfer device in a perspective plan view.

FIG. 1 shows a perspective plan view of a transfer device 1 according to the invention. The transfer device 1 is in an unfolded state ready for use. In the ready-to-use state, the tubular roll cloth 2 is arranged around the inner body 4, not tightly, but also not loosely, such that it can be easily rolled around the inner body 4. A tubular sleeve 3 of the roll cloth 2 is in this case ca. 1 cm longer than the inner body, such that the inner body 4 cannot be seen in this view. The roll cloth 2 of the transfer device 1 can now be displaced or rolled relative to the inner body 4 by a pushing or pulling force being exerted in sliding direction R1.

The tubular sleeve 3 of the roll cloth 2 comprises two openings 16*a*, 16*b* at its ends, at each of which a flexible end profile 17*a*, 17*b* is fastened. With the end profiles 17*a*, 17*b* according to the invention, the risk of substances, in particular liquid substances such as blood or other bodily fluids, getting into the interior of the roll cloth 2 can be reliably reduced and, as a result, strict hygiene requirements can be met. The end profiles 17*a*, 17*b* thus constitute a barrier to the abovementioned liquids and to other forms of contamination.

The end profiles 17*a*, 17*b* are configured in such a way that they substantially close the openings 16*a*, 16*b* at the ends of the sleeve 3 when the roll cloth 2 surrounds the inner body 4. The two mutually opposite long portions of an end profile 17 lie closely on each other in such a way that they come into contact with each other and thus close the openings of the roll cloth 2. At the same time, a rolling movement of the roll cloth 2 around the inner body 4 is not impeded by the flexible or elastic end profiles 17 and is thus possible by application of a slight force.

For a high degree of elasticity, the end profiles 17 of the transfer device 1 shown in FIG. 1 are produced from microcellular rubber. Such a material ensures a smooth rolling action of the end profiles 17*a*, 17*b* and therefore of the roll cloth 2. According to the embodiment in FIG. 1, the end profiles 17*a*, 17*b* are sewn firmly to the sleeve 3.

Figure 2:
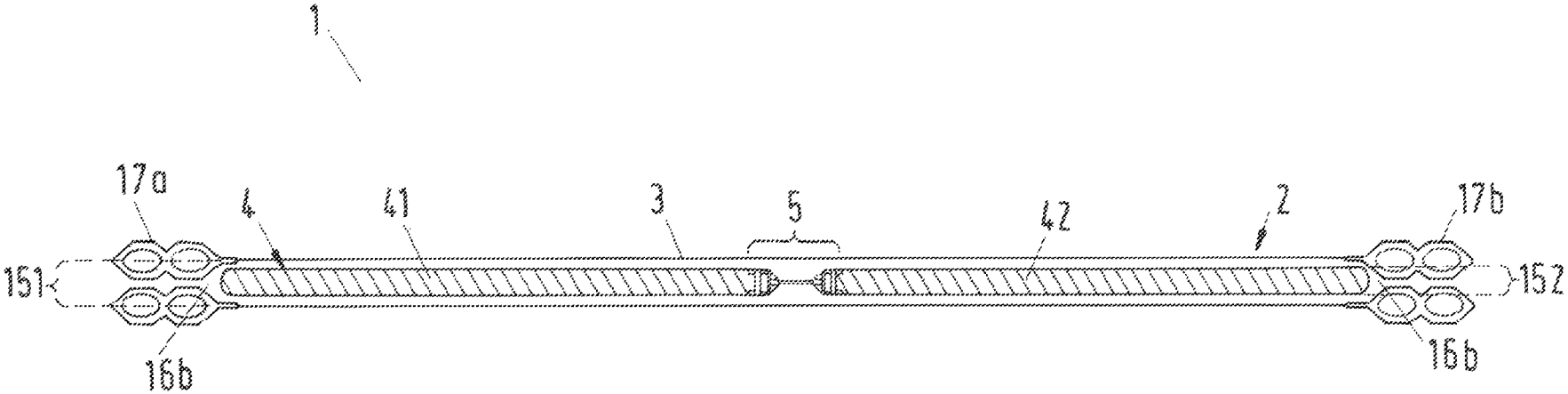
FIG. 2 shows a sectional side view of the transfer device.

FIG. 2 shows a sectional side view of the transfer device 1 with an outer roll cloth 2 and an inner body 4 received inside the sleeve 3. The inner body 4 has a first board 41 and a second board 42, which are connected pivotably to each other along a pivot axis 6 via a connection element 5. The connection element 5 is designed with a first holding profile 71 and a second holding profile 72, wherein the holding profiles 71, 72 each have a receiving region 8*a*, 8*b* in which an edge region 9*a* of the first board 41 and an edge region 9*b* of the second board 42, respectively, are received at least in part with form-fit engagement.

In contrast to what is shown schematically in FIG. 2, the inner face of the roll cloth 2 and the inner body 4 are in contact with each other. Provision is made here that the coefficient of friction between the inner face of the roll cloth and the surface of the inner body is low, such that slight forces alone are sufficient to transfer heavy or overweight patients between beds. The inner body 4, together with the surrounding roll cloth 2, can have a height of 15 to 30 mm, for example.

FIG. 2 additionally shows the flexible end profiles 17. In order to prevent undesired entry of unhygienic substances into the interior of the tubular roll cloth 2, the end profiles 17*a*, 17*b* shown in FIG. 2 protrude inwards. In contrast to what is shown in the schematic view, the upper portion of the end profile 17*a*, 17*b* and the lower portion of the end profile 17*a*, 17*b* come into contact with each other. In this way, penetration of contaminants into the interior of the roll cloth 2 is reliably prevented without the rolling movement of the transfer device 1 being adversely affected thereby. Strict hygiene requirements can thus be met.

Figure 3:
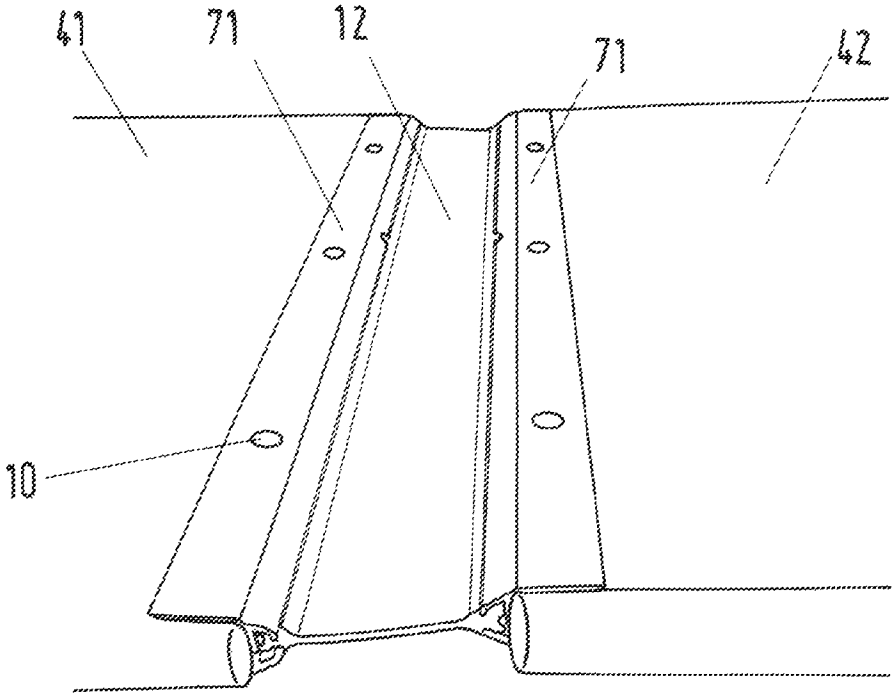
FIG. 3 shows a connection element in a perspective plan view.

FIG. 3 shows a connection element 5 in a perspective plan view. In the embodiment variant shown here, the connection element 5 is designed in the form of a batten which extends substantially across the full width of the unfolded inner body 4. In this way, a gap-free transition is ensured between the first board 41 and the second board 42. The unfolded inner body 4 thus has a more or less complete board structure in which there are no gaps or spaces even in the region of the connection element 5. This results in a particularly comfortable support for the patient. The holding profiles 71, 72 are fastened to the boards 41, 42 via fixing devices 10, with rivets here being used as said fixing devices 10.

Figure 4:
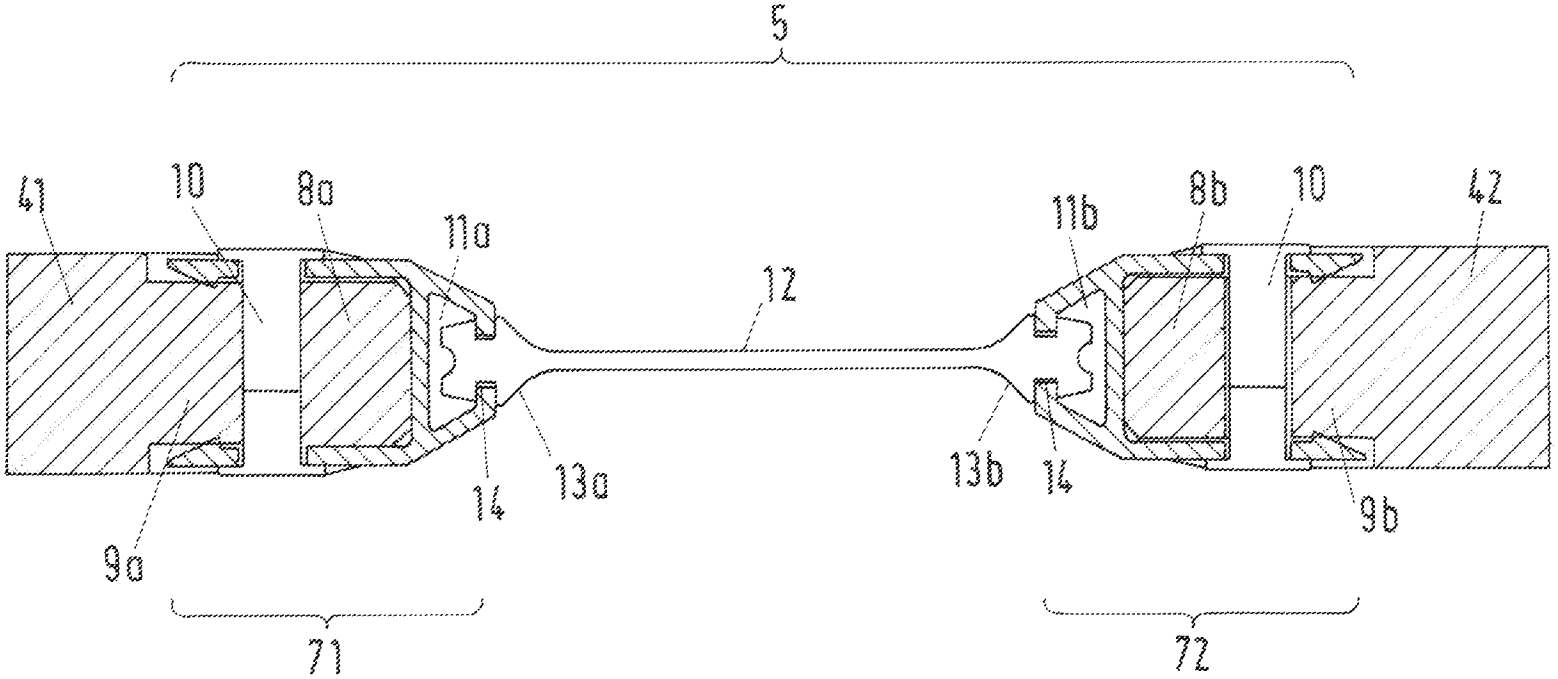
FIG. 4 shows a sectional side view of the connection element.

FIG. 4 shows a sectional side view of the connection element 5. The connection element 5 shown has a first holding profile 71 and second holding profile 72, which are connected to each other via a flexible element 12. Each holding profile 71, 72 has a receiving region 8*a*, 8*b* in which an edge region 9*a*, 9*b* of the first or second board 41, 42 is received. As can be seen from FIG. 4, the edge regions 9*a*, 9*b* have a lesser thickness compared to the remaining part of the boards 41, 42. Edge regions configured in this way make it easier to insert the boards into the receiving regions of the holding profiles 71, 72. In the case of the embodiment shown, the difference in thickness between the edge region 9*a*, 9*b* of a board 41, 42 and the rest of the board 41, 42 corresponds approximately to the wall thickness of the receiving regions 8*a*, 8*b*. In this way, it is possible to ensure a substantially even and smooth transition between the board 41, 42 and the holding profile 71, 72.

The connection element 5 is fastened to the boards 41, 42 by rivet connections 10, wherein rivet pins pass through the upper side of a respective receiving region 8*a*, 8*b* and the upper side of a respective board 41, 42. Analogously to this, the rivet seats pass through the underside of the receiving region 8*a*, 8*b* and the underside of the board 41, 42, such that the rivet seat can receive the rivet pin in the interior of the board 41, 42. In this way, the holding profiles 71, 72 are firmly connected to the two boards 41, 42.

The two holding profiles 71, 72 are connected via a flexible element 12 which has two profiles ends 13*a*, 13*b* and which is arranged between the first holding profile 71 and the second holding profile 72. The profile ends 13*a*, 13*b* have recesses 14 for connecting a profile end 13*a*, 13*b* to the connection region 11*a*, 11*b*, respectively, of a holding profile 71, 72. By way of the recesses 8*a*, 8*b* of the profile ends 13*a*, 13*b*, the flexible element 12 can additionally be joined to the connection region 5 via a clamped connection, effortlessly and without additional components. The flexible element 12 permits the pivotability of the connection element 5, as a result of which the first board 41 is able to pivot relative to the second board 42. The flexible element 12 is preferably produced from an elastic and halogen-free material.

According to the embodiment shown in FIG. 3, the flexible element 12 is strip-shaped or batten-shaped and extends along the entire edge region 9*a*, 9*b* of the boards 41, 42. In this way, a gap-free transition is achieved between the first board 41 and the second board 42, as a result of which the unfolded inner body has a more or less complete board structure in which there are no gaps or spaces even in the region of the connection element 5. By using the flexible element 12, it is also possible to dispense with hinge elements, which results in simpler production of the connection element and therefore of the foldable inner body. The connection regions 11*a*, 11*b* for this purpose have webs, which are received by the recesses of the profile ends. In this way, it is possible to prevent the profile ends from accidentally slipping out of the connection regions.

FIG. 5*a* and FIG. 5*b* show sectional side views of the end profiles 17, which are designed as hollow-chamber profiles 18. It is advantageous if the flexible end profile 17 is designed as such a hollow-chamber profile 18. A hollow-chamber profile 18 is particularly flexible and thus allows the roll cloth 2 to slide easily around the inner body produced from a foam, which inner body thus constitutes a relatively stiff inner core. Moreover, compared to a solid end profile 17 of the same volume but without a hollow chamber 19, it is possible to save on material and to provide a certain amount of pretensioning with which an upper portion of the end profiles lies on the lower portion. A good sealing action is thus obtained.

In this illustrative embodiment, the hollow-chamber profile 18 has a flat fastening portion 20. By way of this fastening portion 20, which is preferably designed like a tab, the end profile 17 or the hollow-chamber profile 18 can be reliably fastened to the sleeve 3 of the roll cloth 2, for example by sewing or adhesive bonding.

The embodiments of the hollow-chamber profile 18 shown in FIG. 5*a* and FIG. 5*b* each have two hollow chambers 19. However, it is also possible in principle to provide further hollow chambers. In this way, the closing action of the end profile 17 is strengthened. The hollow chambers 19 can in this case have an asymmetric geometry along a plane AA', as shown in FIG. 5*b*. An asymmetric geometry of this kind improves the rolling properties of the end profile 17.

The invention is not limited to one of the embodiments described above and can instead be modified in various ways. An essential aspect lies in the flexible design of the end profiles which, on the one hand, seal the interior of the roll cloth, and thus also generally of an inner body located therein, but which, on the other hand, also serve to ensure easy handling. They moreover ensure a soft finish of the transfer device, such that there are no hard edges on the transfer device. The roll cloth is equally suitable for non-foldable and foldable inner bodies with two or more boards connected pivotably to one another.

The soft and thus flexible end profiles allow the omission of solid holding grips connected to the inner body and thus permit almost closed end faces. This permits simple cleaning and allows high standards of hygiene to be maintained.

All of the features and advantages emerging from the claims, the description and the drawing, including design details, spatial arrangements and method steps, may be essential to the invention both on their own and in a wide variety of combinations.

LIST OF REFERENCE SIGNS

1 transfer device
2 roll cloth
3 sleeve
4 inner body
41 first board
42 second board
5 connection element
6 pivot axis
71 first holding profile
72 second holding profile
8*a*, 8*b* receiving region
9*a*, 9*b* edge region
10 fixing device
11*a*, 11*b* connection region
12 flexible element
13*a*, 13*b* profile ends
14 recesses
151 outer cross-sectional periphery
152 inner cross-sectional periphery
16*a*, 16*b* open ends
17*a*, 17*b* end profile
18 hollow-chamber profile
19 hollow chamber
20 fastening portion
AA' plane

The invention claimed is:

1. Transfer device for transferring a patient, comprising: a roll cloth which has a tubular sleeve with two open ends, wherein the roll cloth has, at each of the open ends of the sleeve, a peripheral end profile with an inner face and an outer face, which end profile is elastic, wherein, in the ready-to-use state of the roll cloth, the inner face of an upper portion of the end profile lies on the inner face of a lower portion of the end profile, wherein an inner body is received inside the tubular sleeve, wherein the sleeve of the roll cloth is longer than the inner body, wherein the end profile is designed as a hollow-chamber profile with at least one hollow chamber which extends parallel to the end of the sleeve, wherein the end profile has a flat fastening portion which is covered by the sleeve, and wherein the hollow profiles lie outside the sleeve.

2. Transfer device according to claim 1, wherein the end profile has a thickness of between 0.5 and 5 cm and a height of between 3 cm and 10 cm.

3. Transfer device according to claim 1, wherein the end profile has a rubber-like material.

4. Transfer device according to claim 1, wherein at least one concave recess is formed on the inner face and/or the outer face of the end profile.

5. Transfer device according to claim 1, wherein the hollow-chamber profile has at least two hollow chambers which lie next to each other in the longitudinal direction.

6. Transfer device according to claim 1, wherein the end profile has a flat fastening portion which is in particular sewn to the sleeve.

7. Transfer device according to claim 5, wherein the hollow-chamber profile extends an equal distance on both sides of a plane in which the fastening portion lies.

8. Transfer device of claim 1, wherein the inner body has a first board and a second board which are connected pivotably to each other along a pivot axis via a connection element, wherein the connection element has a first holding profile and a second holding profile.

9. Transfer device according to claim 8, wherein the first holding profile and the second holding profile each have a receiving region, wherein an edge region of the first board is received at least in part with form-fit engagement in the receiving region of the first holding profile, and an edge region of the second board is received at least in part with form-fit engagement in the receiving region of the second holding profile.

10. Transfer device according to claim 9, wherein the edge region of the first board has a lesser thickness compared to the rest of the first board, and in that the edge region of the second board has a lesser thickness compared to the rest of the second board.

11. Transfer device of claim 8, wherein the first holding profile is fixed by a fixing device to the edge region of the first board, and in that the second holding profile is fixed by a fixing device to the edge region of the second board.

12. Transfer device of claim 8, wherein the first holding profile and the second holding profile each have a connection region, which is in each case designed in a direction counter to the receiving region.

13. Transfer device of claim 8, wherein the connection element has a flexible element with at least two profile ends, wherein the flexible element is arranged between the first holding profile and the second holding profile.

14. Transfer device of claim 1, wherein an outer cross-sectional periphery of the inner body corresponds substantially to an inner cross-sectional periphery of the tubular roll cloth.

15. Transfer device for transferring a patient, comprising: a roll cloth which has a tubular sleeve with two open ends, wherein the roll cloth has, at each of the open ends of the sleeve, a peripheral end profile with an inner face and an outer face, which end profile is elastic, wherein, in the ready-to-use state of the roll cloth, the inner face of an upper portion of the end profile lies on the inner face of a lower portion of the end profile, wherein an inner body is received inside the tubular sleeve, wherein the sleeve of the roll cloth is longer than the inner body, and wherein the end profile is designed as a hollow-chamber profile with at least one hollow chamber which extends parallel to the end of the sleeve, wherein the hollow-chamber profile has at least two hollow chambers which lie next to each other in the longitudinal direction, wherein the hollow-chamber profile extends by different distances on both sides of a plane in which the fastening portion lies, and wherein the hollow-chamber profile extends further in the direction of the inner face than in the direction of the outer face.

* * * * *